US010714034B2

(12) United States Patent
Li et al.

(10) Patent No.: US 10,714,034 B2
(45) Date of Patent: Jul. 14, 2020

(54) DISPLAY DEVICE, CONTROL CIRCUIT OF DISPLAY PANEL, AND DISPLAY METHOD

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Yan Li, Beijing (CN); Zijiao Xue, Beijing (CN); Shuaishuai Xu, Beijing (CN); Lingyun Shi, Beijing (CN); Wei Sun, Beijing (CN); Guangquan Wang, Beijing (CN); Dong Chen, Beijing (CN); Xue Dong, Beijing (CN); Shengji Yang, Beijing (CN); Xiaochuan Chen, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/750,690

(22) PCT Filed: Jul. 27, 2017

(86) PCT No.: PCT/CN2017/094720
§ 371 (c)(1),
(2) Date: Feb. 6, 2018

(87) PCT Pub. No.: WO2018/126655
PCT Pub. Date: Jul. 12, 2018

(65) Prior Publication Data

US 2020/0090602 A1 Mar. 19, 2020

(30) Foreign Application Priority Data

Jan. 3, 2017 (CN) ..... 2017 1 0001345

(51) Int. Cl.
*G09G 3/36* (2006.01)

(52) U.S. Cl.
CPC ... *G09G 3/3607* (2013.01); *G09G 2320/0242* (2013.01); *G09G 2320/0686* (2013.01); *G09G 2330/023* (2013.01)

(58) Field of Classification Search
CPC ..... G09G 3/3607; G09G 2320/0686; G09G 3/2003; G09G 2340/06; G09G 2320/0242;
(Continued)

(56) References Cited

U.S. PATENT DOCUMENTS 7,808,475 B2 10/2010 Brown
2010/0178035 A1 7/2010 Xie
(Continued)

FOREIGN PATENT DOCUMENTS

CN 1862654 A 11/2006
CN 1863283 A 11/2006
(Continued)

OTHER PUBLICATIONS

Second Office Action for Chinese Application No. 201710001345.2, dated Mar. 11, 2019, 13 pages.
(Continued)

*Primary Examiner* — Sanjiv D. Patel
(74) *Attorney, Agent, or Firm* — Brooks Kushman P.C.

(57) ABSTRACT

The present disclosure provides a display device, a control circuit of a display panel, and a display method. The display method includes: determining a current display mode of the display panel; and determining whether or not to subject a to-be-displayed image on the display panel to color enhancement in accordance with the current display mode of the display panel and/or an image parameter of the to-be-displayed image.

16 Claims, 4 Drawing Sheets

(58) Field of Classification Search
CPC ..... G09G 2360/16; G09G 2330/021; G09G 5/026; G09G 2320/0666; G09G 5/06; G09G 2320/0693; G09G 2320/0673; G09G 2320/0271; G09G 2320/0276; G06T 3/4053; G06T 2207/10024; G06T 2207/10016; G06T 7/90
See application file for complete search history.

(56) References Cited

U.S. PATENT DOCUMENTS

| | | | | |
|---|---|---|---|---|
| 2010/0309099 | A1* | 12/2010 | Kim | G09G 3/3233 345/55 |
| 2011/0317918 | A1 | 12/2011 | Guerreiro et al. | |
| 2012/0044260 | A1* | 2/2012 | Hirai | H04N 13/302 345/629 |
| 2016/0246430 | A1* | 8/2016 | Wang | G06F 3/0416 |
| 2016/0267856 | A1* | 9/2016 | Chen | G09G 5/026 |
| 2017/0039919 | A1* | 2/2017 | Wu | G09G 3/2003 |
| 2017/0310901 | A1* | 10/2017 | Sheikh | H04N 5/23296 |
| 2018/0025682 | A1* | 1/2018 | Min | G06T 7/90 345/589 |

FOREIGN PATENT DOCUMENTS

| | | | |
|---|---|---|---|
| CN | 102265593 | A | 11/2011 |
| CN | 102295593 | A | 12/2011 |
| CN | 102314673 | A | 1/2012 |
| CN | 104680490 | A | 6/2015 |
| CN | 106060341 | A | 10/2016 |
| CN | 106448612 | A | 2/2017 |
| CN | 106486081 | A | 3/2017 |

OTHER PUBLICATIONS

International Search Report and Written Opinion for Application No. PCT/CN2017/094720, dated Nov. 7, 2017, 9 Pages.
First Office Action for Chinese Application No. 201710001345.2, dated Jul. 4, 2018, 7 Pages.

* cited by examiner

DISPLAY DEVICE, CONTROL CIRCUIT OF DISPLAY PANEL, AND DISPLAY METHOD

CROSS-REFERENCE TO RELATED APPLICATIONS

This application is the U.S. national phase of PCT Application No. PCT/CN2017/094720 filed on Jul. 27, 2017, which claims priority to Chinese Patent Application No. 201710001345.2 filed on Jan. 3, 2017, which are incorporated herein by reference in their entireties.

TECHNICAL FIELD

The present disclosure relates to the field of display technology, in particular to a display device, a control circuit of a display panel, and a display method.

BACKGROUND

Along with the development of the display technology, higher display quality is demanded. Visual enjoyment may be provided in a better manner through brilliant colors, so currently more and more driver integrated circuit (ICs) of liquid crystal displays are provide an image color enhancement function, so as to improve the display quality.

However, in the related art, during the image color enhancement, the power consumption of the display device may increase significantly.

SUMMARY

An object of the present disclosure is to provide a display device, a control circuit of a display panel, and a display method, so as to reduce the power consumption of the display device while improving the display quality.

In one aspect, the present disclosure provides in some embodiments a display method for a display panel, including steps of: determining a current display mode of the display panel; and determining whether or not to subject a to-be-displayed image on the display panel to color enhancement in accordance with the current display mode of the display panel and/or an image parameter of the to-be-displayed image.

In a possible embodiment of the present disclosure, the step of determining whether or not to subject the to-be-displayed image on the display panel to the color enhancement in accordance with the current display mode of the display panel and/or the image parameter of the to-be-displayed image includes, in the case that the current display mode of the display panel is a first display mode, not subjecting the to-be-displayed image on the display panel to the color enhancement. In the case that the display panel is in the first display mode, power consumption of the display panel is smaller than a predetermined threshold.

In a possible embodiment of the present disclosure, the step of determining whether or not to subject the to-be-displayed image on the display panel to the color enhancement in accordance with the current display mode of the display panel and/or the image parameter of the to-be-displayed image includes: in the case that the current display mode of the display panel is a second display mode, dividing the display panel into a predetermined number of display regions, and dividing the to-be-displayed image into a predetermined number of display sub-images corresponding to the display regions in a one-to-one correspondence manner; acquiring a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; in the case that the grayscale change value of one of the display sub-images is greater than a first predetermined threshold, subjecting the display sub-image to the color enhancement; and in the case that the grayscale change value of one of the display sub-images is not greater than the first predetermined threshold, not subjecting the display sub-image to the color enhancement.

In a possible embodiment of the present disclosure, the step of determining whether or not to subject the to-be-displayed image on the display panel to the color enhancement in accordance with the current display mode of the display panel and/or the image parameter of the to-be-displayed image includes: in the case that the current display mode of the display panel is a third display mode, dividing the to-be-displayed image into a predetermined number of display sub-images; acquiring a resolution of each of the display sub-images; in the case that the resolution of one of the display sub-images is greater than a second predetermined threshold, subjecting the display sub-image to the color enhancement; and in the case that the resolution of one of the display sub-images is not greater than the second predetermined threshold, not subjecting the display sub-image to the color enhancement.

In another aspect, the present disclosure provides in some embodiments a control circuit of a display panel, including: a display mode determination module configured to determine a current display mode of the display panel; and a processing module configured to determine whether or not to subject a to-be-displayed image on the display panel to color enhancement in accordance with the current display mode of the display panel and/or an image parameter of the to-be-displayed image.

In a possible embodiment of the present disclosure, the processing module includes a first processing unit configured to, in the case that the current display mode of the display panel is a first display mode, not subject the to-be-displayed image on the display panel to the color enhancement. In the case that the display panel is in the first display mode, power consumption of the display panel is smaller than a predetermined threshold.

In a possible embodiment of the present disclosure, the processing module includes: a division unit configured to, in the case that the current display mode of the display panel is a second display mode, divide the display panel into a predetermined number of display regions, and divide the to-be-displayed image into a predetermined number of display sub-images corresponding to the display regions in a one-to-one correspondence manner; a calculation unit configured to acquire a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; and a second processing unit configured to, in the case that the grayscale change value of one of the display sub-images is greater than a first predetermined threshold, subject the display sub-image to the color enhancement, and in the case that the grayscale change value of one of the display sub-images is not greater than the first predetermined threshold, not subject the display sub-image to the color enhancement.

In a possible embodiment of the present disclosure, the processing module includes: a division unit configured to, in the case that the current display mode of the display panel is a third display mode, divide the to-be-displayed image into a predetermined number of display sub-images; a resolution acquisition unit configured to acquire a resolution of each of the display sub-images; and a third processing unit configured to, in the case that the resolution of one of the display sub-images is greater than a second predetermined threshold, subject the display sub-image to the color enhancement; and in the case that the resolution of one of the display sub-images is not greater than the second predetermined threshold, not subject the display sub-image to the color enhancement.

In yet another aspect, the present disclosure provides in some embodiments a display device including a display panel and the above-mentioned control circuit of the display panel.

In a possible embodiment of the present disclosure, a base substrate of the display panel is a silicon substrate, and the control circuit of the display panel is integrated into the silicon substrate.

In still yet another aspect, the present disclosure provides in some embodiments a control circuit of a display panel, including a processor and a memory. The processor is configured to read a program stored in the memory, so as to determine a current display mode of the display panel, and determine whether or not to subject a to-be-displayed image on the display panel to color enhancement in accordance with the current display mode of the display panel and/or an image parameter of the to-be-displayed image. The memory is configured to store therein data for the operation of the processor.

BRIEF DESCRIPTION OF THE DRAWINGS

In order to illustrate the technical solutions of the present disclosure in a clearer manner, the drawings desired for the present disclosure will be described hereinafter briefly. Obviously, the following drawings merely relate to some embodiments of the present disclosure, and based on these drawings, a person skilled in the art may obtain the other drawings without any creative effort. Shapes and sizes of the members in the drawings are for illustrative purposes only, but shall not be used to reflect any actual scale.

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

In the related art, during image color enhancement of an image displayed by a display device, power consumption of the display device may increase significantly. An object of the present disclosure is to provide a display device, a control circuit of a display panel, and a display method, so as to reduce the power consumption of the display device while improving the display quality.

Figure 1:
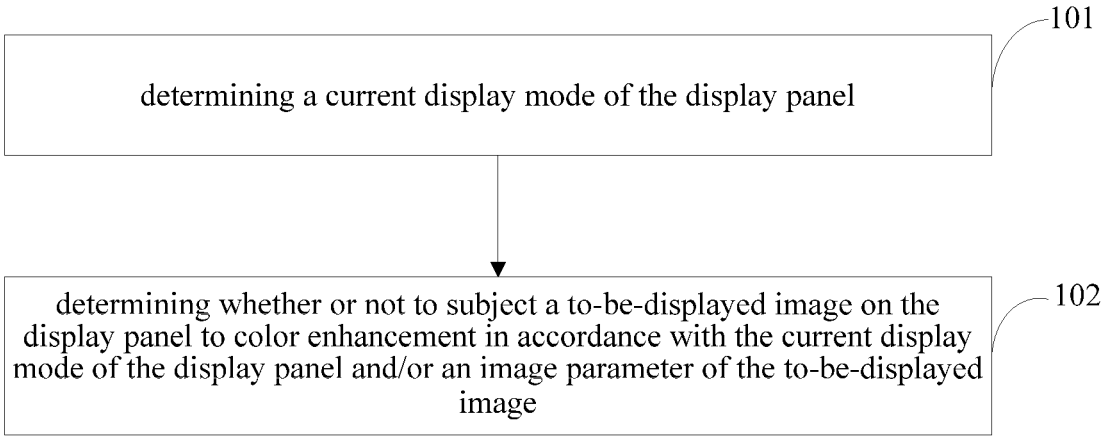
FIG. 1 is a flow chart of a display method for a display panel according to one embodiment of the present disclosure.

The present disclosure provides in some embodiments a display method of a display panel which, as shown in FIG. 1, includes: Step 101 of determining a current display mode of the display panel; and Step 102 of determining whether or not to subject a to-be-displayed image on the display panel to color enhancement in accordance with the current display mode of the display panel and/or an image parameter of the to-be-displayed image.

According to the display method in the embodiments of the present disclosure, it determines whether or not to subject the to-be-displayed image to the color enhancement in accordance with the current display mode of the display panel and the image parameter of the to-be-displayed image. For example, a part of the to-be-displayed image at a region in a moderate color may not be subjected to the color enhancement, and a part of the to-be-displayed image at a region in a brilliant color may be subjected to the color enhancement. For another example, a part of the to-be-displayed image with a low resolution may not be subjected to the color enhancement, and a part of the to-be-displayed image with a high resolution may be subjected to the color enhancement. As a result, it is able to significantly reduce the power consumption of the display device without adversely affecting the user experience.

Figure 2:
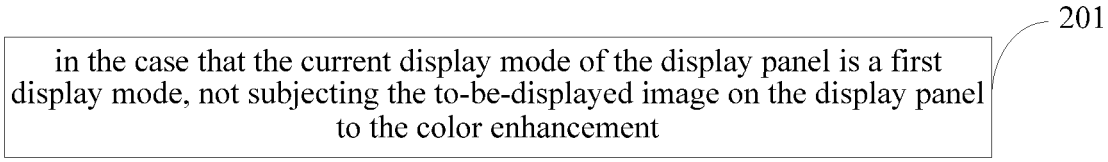
FIG. 2 is a flow chart of a step of determining whether or not to subject a to-be-displayed image on the display panel to color enhancement in accordance with a current display mode of the display panel and/or an image parameter of the to-be-displayed image according to one embodiment of the present disclosure.

In a possible embodiment of the present disclosure, as shown in FIG. 2, the step of determining whether or not to subject the to-be-displayed image on the display panel to the color enhancement in accordance with the current display mode of the display panel and/or the image parameter of the to-be-displayed image includes, Step 201 of, in the case that the current display mode of the display panel is a first display mode, not subjecting the to-be-displayed image on the display panel to the color enhancement. In the case that the display panel is in the first display mode, power consumption of the display panel is smaller than a predetermined threshold.

In this way, in the case that the power consumption of the display panel is required to be small, e.g., in the case that the display panel is in a power-saving mode, the to-be-displayed image on the display panel may not be subjected to the color enhancement, so as to reduce the power consumption of the display panel. In the case that the power consumption of the display panel is not required to be small but a higher display quality is demanded, e.g., in the case that the display panel is in a normal operating mode, the to-be-displayed image on the display panel may be subjected to the color enhancement, so as to ensure the display quality.

Figure 3:
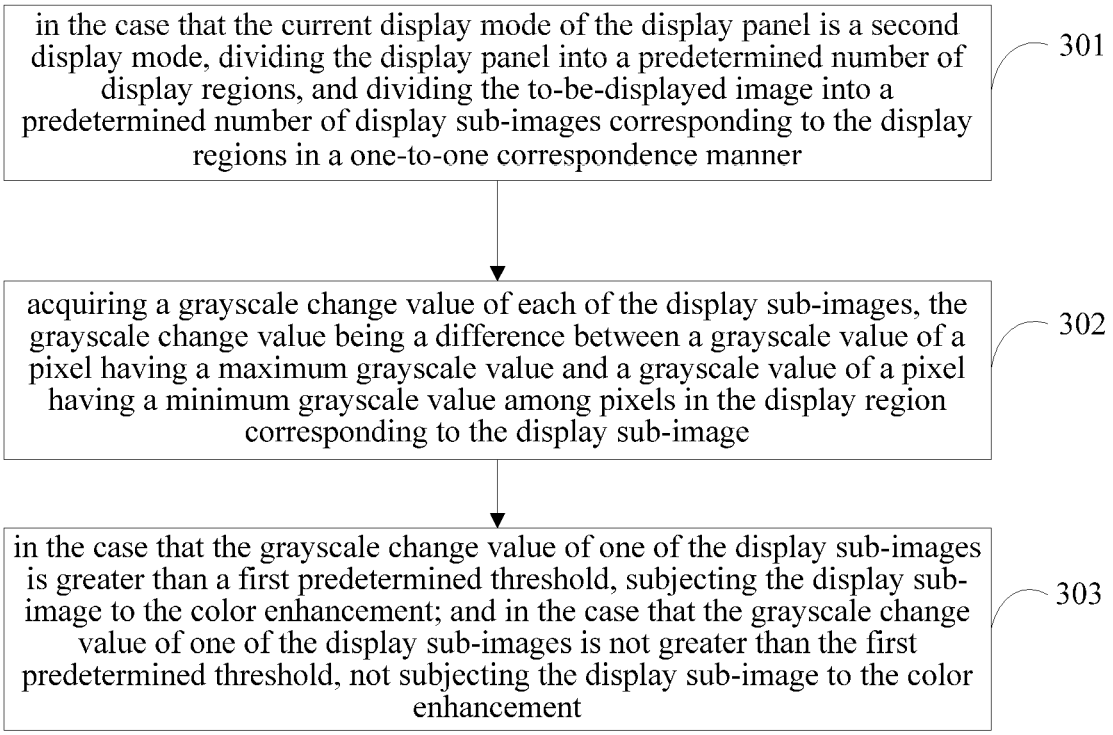
FIG. 3 is another flow chart of the step of determining whether or not to subject the to-be-displayed image on the display panel to the color enhancement in accordance with the current display mode of the display panel and/or the image parameter of the to-be-displayed image according to one embodiment of the present disclosure.

In a possible embodiment of the present disclosure, as shown in FIG. 3, the step of determining whether or not the to-be-displayed image on the display panel is to be subjected to the color enhancement in accordance with the current display mode of the display panel and/or the image parameter of the to-be-displayed image includes: Step 301 of, in the case that the current display mode of the display panel is a second display mode, dividing the display panel into a predetermined number of display regions, and dividing the to-be-displayed image into a predetermined number of display sub-images corresponding to the display regions in a one-to-one correspondence manner; Step 302 of acquiring a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; and Step 303 of, in the case that the grayscale change value of one of the display sub-images is greater than a first predetermined threshold, subjecting the display sub-image to the color enhancement, and in the case that the grayscale change value of one of the display sub-images is not greater than the first predetermined threshold, not subjecting the display sub-image to the color enhancement. The first predetermined threshold may be set in accordance with the practical need. To be specific, the first predetermined threshold may be a grayscale value of 30.

In this way, a part of the to-be-displayed image at a region of the display panel in a brilliant color may be subjected to the color enhancement, and a part of the to-be-displayed image at a region of the display panel in a dim color may not be subjected to the color enhancement. As a result, it is able to significantly reduce the power consumption of the display device without adversely affecting the user experience.

Figure 4:
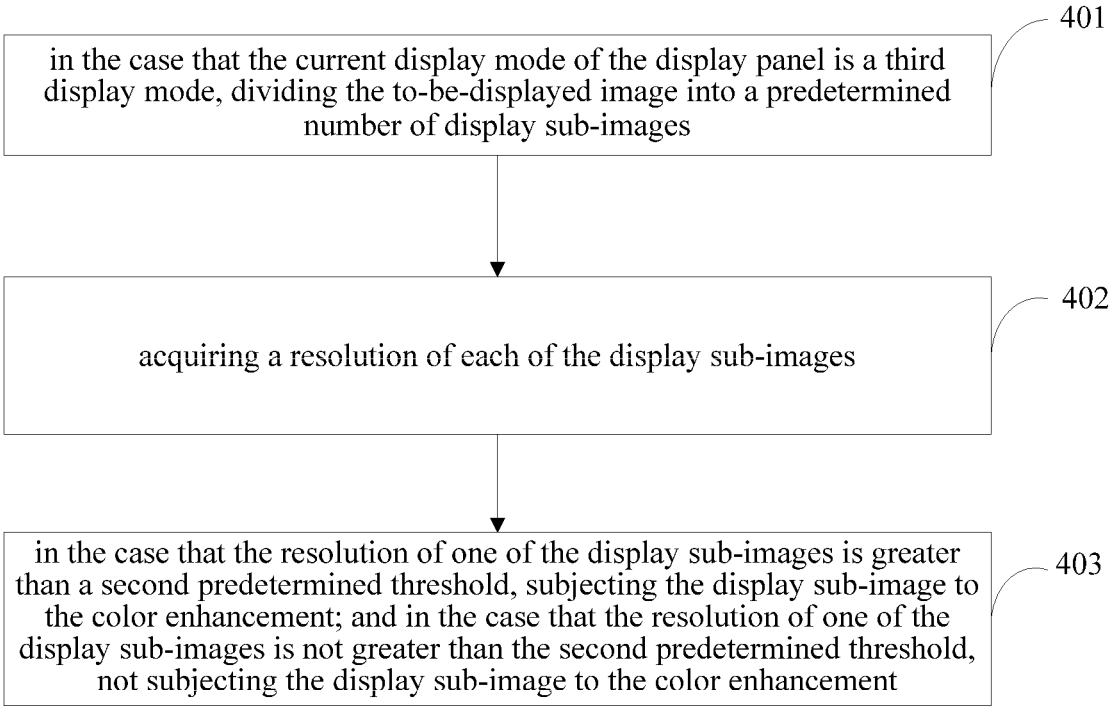
FIG. 4 is yet another flow chart of the step of determining whether or not to subject the to-be-displayed image on the display panel to the color enhancement in accordance with the current display mode of the display panel and/or the image parameter of the to-be-displayed image according to one embodiment of the present disclosure.

In a possible embodiment of the present disclosure, as shown in FIG. 4, the step of determining whether or not to subject the to-be-displayed image on the display panel to the color enhancement in accordance with the current display mode of the display panel and/or the image parameter of the to-be-displayed image includes: Step 401 of, in the case that the current display mode of the display panel is a third display mode, dividing the to-be-displayed image into a predetermined number of display sub-images; Step 402 of acquiring a resolution of each display sub-image; and Step 403 of, in the case that the resolution of one of the display sub-images is greater than a second predetermined threshold, subjecting the display sub-image to the color enhancement, and in the case that the resolution of one of the display sub-images is not greater than the second predetermined threshold, not subjecting the display sub-image to the color enhancement. The second predetermined threshold may be set in accordance with the practical need.

In this way, a part of the to-be-displayed image at a region of the display panel where a high-resolution image is to be displayed may be subjected to the color enhancement, and a part of the to-be-displayed image at a region of the display panel where a low-resolution image is to be displayed may not be subjected to the color enhancement. As a result, it is able to significantly reduce the power consumption of the display device without adversely affecting the user experience.

Figure 5:
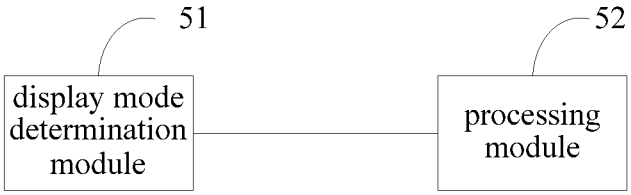
FIG. 5 is a schematic view showing a control circuit of a display panel according to one embodiment of the present disclosure.

The present disclosure further provides in some embodiments a control circuit of a display panel which, as shown in FIG. 5, includes: a display mode determination module 51 configured to determine a current display mode of the display panel; and a processing module 52 configured to determine whether or not to subject a to-be-displayed image on the display panel to color enhancement in accordance with the current display mode of the display panel and/or an image parameter of the to-be-displayed image.

According to the control circuit in the embodiments of the present disclosure, whether or not to subject the to-be-displayed image to the color enhancement is determined in accordance with the current display mode of the display panel and the image parameter of the to-be-displayed image. For example, a part of the to-be-displayed image at a region in a moderate color may not be subjected to the color enhancement, and a part of the to-be-displayed image at a region in a brilliant color may be subjected to the color enhancement. For another example, a part of the to-be-displayed image with a low resolution may not be subjected to the color enhancement, and a part of the to-be-displayed image with a high resolution may be subjected to the color enhancement. As a result, it is able to significantly reduce the power consumption of the display device without adversely affecting the user experience.

Figure 6:
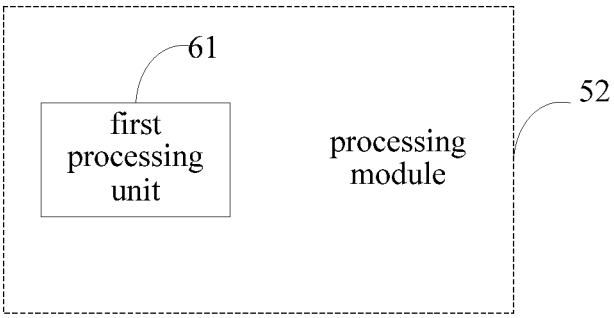
FIG. 6 is a schematic view showing a processing module according to one embodiment of the present disclosure.

In a possible embodiment of the present disclosure, as shown in FIG. 6, the processing module 52 includes a first processing unit 61 configured to, in the case that the current display mode of the display panel is a first display mode, not subject the to-be-displayed image on the display panel to the color enhancement. In the case that the display panel is in the first display mode, power consumption of the display panel is smaller than a predetermined threshold.

In this way, in the case that the power consumption of the display panel is required to be small, e.g., in the case that the display panel is in a power-saving mode, the to-be-displayed image on the display panel may not be subjected to the color enhancement, so as to reduce the power consumption of the display panel. In the case that the power consumption of the display panel is not required to be small but the higher display quality is demanded, e.g., in the case that the display panel is in a normal operating mode, the to-be-displayed image on the display panel may be subjected to the color enhancement, so as to ensure the display quality.

Figure 7:
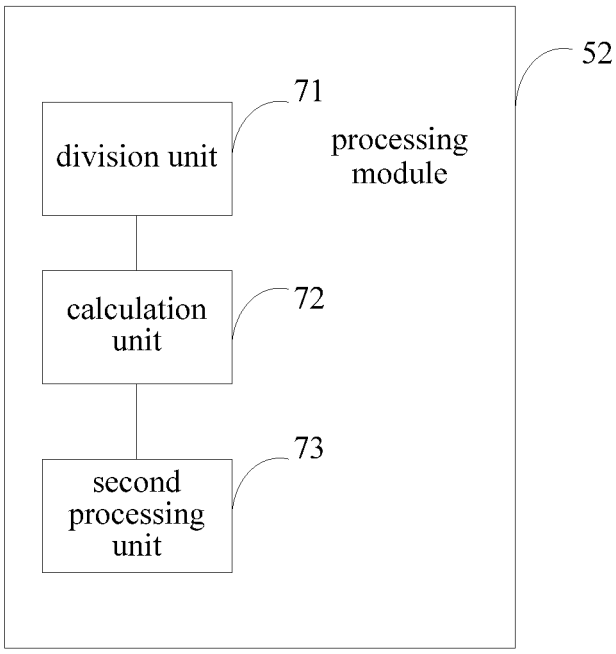
FIG. 7 is another schematic view showing the processing module according to one embodiment of the present disclosure.

In a possible embodiment of the present disclosure, as shown in FIG. 7, the processing module 52 includes: a division unit 71 configured to, in the case that the current display mode of the display panel is a second display mode, divide the display panel into a predetermined number of display regions, and divide the to-be-displayed image into a predetermined number of display sub-images corresponding to the display regions in a one-to-one correspondence manner; a calculation unit 72 configured to acquire a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; and a second processing unit 73 configured to, in the case that the grayscale change value of one of the display sub-images is greater than a first predetermined threshold, subject the display sub-image to the color enhancement, and in the case that the grayscale change value of one of the display sub-images is not greater than the first predetermined threshold, not subject the display sub-image to the color enhancement.

In this way, a part of the to-be-displayed image at a region of the display panel in a brilliant color may be subjected to the color enhancement, and a part of the to-be-displayed image at a region of the display panel in a dim color may not be subjected to the color enhancement. As a result, it is able to significantly reduce the power consumption of the display device without adversely affecting the user experience.

Figure 8:
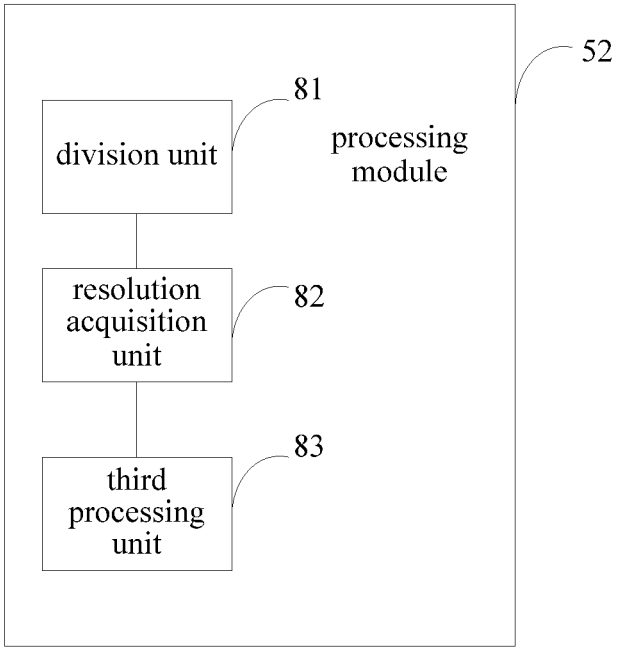
FIG. 8 is yet another schematic view showing the processing module according to one embodiment of the present disclosure.

In a possible embodiment of the present disclosure, as shown in FIG. 8, the processing module 52 includes: a division unit 81 configured to, in the case that the current display mode of the display panel is a third display mode, divide the to-be-displayed image into a predetermined number of display sub-images; a resolution acquisition unit 82 configured to acquire a resolution of each display sub-image; and a third processing unit 83 configured to, in the case that the resolution of one of the display sub-images is greater than a second predetermined threshold, subject the display sub-image to the color enhancement; and in the case that the resolution of one of the display sub-images is not greater than the second predetermined threshold, not subject the display sub-image to the color enhancement.

In this way, a part of the to-be-displayed image at a region of the display panel where a high-resolution image is to be displayed may be subjected to the color enhancement, and a part of the to-be-displayed image at a region of the display panel where a low-resolution image is to be displayed may not be subjected to the color enhancement. As a result, it is able to significantly reduce the power consumption of the display device without adversely affecting the user experience.

The present disclosure further provides in some embodiments a display device including a display panel and the above-mentioned control circuit of the display panel. The display device may be any product or member having a display function, e.g., a television, a display, a digital photo frame, a mobile phone or a flat-panel computer. The display device may further include a flexible circuit board, a printed circuit board and a back plate.

In a possible embodiment of the present disclosure, a base substrate of the display panel may be a silicon substrate, and the control circuit of the display panel may be integrated into the silicon substrate. The silicon substrate has a very strong information storage capability, so the control circuit of the display panel may be integrated into the silicon substrate, so as to simplify the structure of the display device.

According to the display device in the embodiments of the present disclosure, whether or not to subject the to-be-displayed image to the color enhancement is determined in accordance with the current display mode of the display panel and the image parameter of the to-be-displayed image. For example, a part of the to-be-displayed image at a region in a moderate color may not be subjected to the color enhancement, and a part of the to-be-displayed image at a region in a brilliant color may be subjected to the color enhancement. For another example, a part of the to-be-displayed image with a low resolution may not be subjected to the color enhancement, and a part of the to-be-displayed image with a high resolution may be subjected to the color enhancement. As a result, it is able to significantly reduce the power consumption of the display device without adversely affecting the user experience.

Some functional members described in the specification are referred to as modules or units, so as to emphasize the independence of the implementation in a more particular manner.

In the embodiments of the present disclosure, the modules or units (including but not limited to the display mode determination module 51, the processing module 52, the first processing unit 61, the division unit 71, the calculation unit 72, the second processing unit 73, the division unit 81, the resolution acquisition unit 82 and the third processing unit 83) may be implemented by software, so as to be executed by any one of various processors. For example, an identified, executable code module or unit may include one or more physical or logical blocks including computer instructions, and for example, the module may be constructed as an object, a process or a function. Even so, the executable codes of the identified modules are unnecessary to be physically located together, but may include different instructions stored in different physical locations. In the case that these instructions are logically combined together, they form the modules or units and achieve the prescribed purposes of the modules or units.

Actually, the executable code module or unit may be a single instruction or a plurality of instructions, and may even be distributed at different code segments, in different programs, or across a plurality of memory devices. Also, operational data may be identified in the modules or units, implemented in any appropriate form, and organized in any data structure of an appropriate type. The operational data may be collected as a single data set, or distributed at different locations (including different memory devices), and may be at least partially present in a system or network merely as an electronic signal.

In addition, the modules or units (including but not limited to the display mode determination module 51, the processing module 52, the first processing unit 61, the division unit 71, the calculation unit 72, the second processing unit 73, the division unit 81, the resolution acquisition unit 82 and the third processing unit 83) may be implemented by a corresponding hardware circuit. The hardware circuit includes a very-large-scale integration (VLSI) circuit, a gate array, a semiconductor such as a logic chip or a transistor, or another discrete component in the related art. The modules or units may further be implemented by a programmable hardware device, such as a field-programmable gate array, a programmable array logic device and a programmable logic device.

In the method embodiments of the present disclosure, the order of the steps is not limited to the serial numbers thereof. For a person skilled in the art, any change in the order of the steps shall also fall within the scope of the present disclosure if without any creative effort.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display method for a display panel, comprising:

determining a current display mode of the display panel; and determining whether or not to subject a to-be-displayed image on the display panel to color enhancement in accordance with at least one of the current display mode of the display panel and an image parameter of the to-be-displayed image, wherein determining whether or not to subject the to-be-displayed image on the display panel to the color enhancement in accordance with at least one of the current display mode of the display panel and the image parameter of the to-be-displayed image comprises:

in the case that the current display mode of the display panel is a first display mode, not subjecting the to-be-displayed image on the display panel to the color enhancement, wherein in the case that the display panel is in the first display mode, power consumption of the display panel is smaller than a predetermined threshold.

2. The display method according to claim 1, wherein determining whether or not to subject the to-be-displayed image on the display panel to the color enhancement in accordance with at least one of the current display mode of the display panel and the image parameter of the to-be-displayed image further comprises:

in the case that the current display mode of the display panel is a second display mode, dividing the display panel into a predetermined number of display regions, and dividing the to-be-displayed image into a predetermined number of display sub-images corresponding to the display regions in a one-to-one correspondence manner;

acquiring a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image;

in the case that the grayscale change value of one of the display sub-images is greater than a first predetermined threshold, subjecting the display sub-image to the color enhancement; and in the case that the grayscale change value of one of the display sub-images is not greater than the first predetermined threshold, not subjecting the display sub-image to the color enhancement.

3. The display method according to claim 1, wherein determining whether or not to subject the to-be-displayed image on the display panel to the color enhancement in accordance with at least one of the current display mode of the display panel and the image parameter of the to-be-displayed image further comprises:

in the case that the current display mode of the display panel is a third display mode, dividing the to-be-displayed image into a predetermined number of display sub-images;

acquiring a resolution of each of the display sub-images;

in the case that the resolution of one of the display sub-images is greater than a second predetermined threshold, subjecting the display sub-image to the color enhancement; and in the case that the resolution of one of the display sub-images is not greater than the second predetermined threshold, not subjecting the display sub-image to the color enhancement.

4. A control circuit of a display panel, comprising:

a display mode determination circuit configured to determine a current display mode of the display panel; and a processing circuit configured to determine whether or not to subject a to-be-displayed image on the display panel to color enhancement in accordance with at least one of the current display mode of the display panel and an image parameter of the to-be-displayed image, wherein the processing circuit comprises:

a first processing circuit configured to, in the case that the current display mode of the display panel is a first display mode, not subject the to-be-displayed image on the display panel to the color enhancement, wherein in the case that the display panel is in the first display mode, power consumption of the display panel is smaller than a predetermined threshold.

5. The control circuit according to claim 4, wherein the processing circuit further comprises:

a division circuit configured to, in the case that the current display mode of the display panel is a second display mode, divide the display panel into a predetermined number of display regions, and divide the to-be-displayed image into a predetermined number of display sub-images corresponding to the display regions in a one-to-one correspondence manner;

a calculation circuit configured to acquire a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; and a second processing circuit configured to, in the case that the grayscale change value of one of the display sub-images is greater than a first predetermined threshold, subject the display sub-image to the color enhancement; and in the case that the grayscale change value of one of the display sub-images is not greater than the first predetermined threshold, not subject the display sub-image to the color enhancement.

6. The control circuit according to claim 4, wherein the processing circuit further comprises:

a division circuit configured to, in the case that the current display mode of the display panel is a third display mode, divide the to-be-displayed image into a predetermined number of display sub-images;

a resolution acquisition unit configured to acquire a resolution of each of the display sub-images; and a third processing circuit configured to, in the case that the resolution of one of the display sub-images is greater than a second predetermined threshold, subject the display sub-image to the color enhancement; and in the case that the resolution of one of the display sub-images is not greater than the second predetermined threshold, not subject the display sub-image to the color enhancement.

7. A display device, comprising the control circuit according to claim 4 and the display panel.

8. The display device according to claim 7, wherein a base substrate of the display panel is a silicon substrate, and the control circuit of the display panel is integrated into the silicon substrate.

9. A control circuit of a display panel, comprising a processor and a memory, wherein the processor is configured to read a program stored in the memory to:

determine a current display mode of the display panel; and determine whether or not to subject a to-be-displayed image on the display panel to color enhancement in accordance with at least one of the current display mode of the display panel and an image parameter of the to-be-displayed image; and the memory is configured to store therein data for the operation of the processor, wherein the processor is further configured to read a program stored in the memory to: in the case that the current display mode of the display panel is a first display mode, not subject the to-be-displayed image on the display panel to the color enhancement, wherein in the case that the display panel is in the first display mode, power consumption of the display panel is smaller than a predetermined threshold.

10. The display device according to claim 7, wherein a base substrate of the display panel is a silicon substrate, and the control circuit of the display panel is integrated into the silicon substrate.

11. The display device according to claim 7, wherein the processing circuit further comprises:

a division circuit configured to, in the case that the current display mode of the display panel is a second display mode, divide the display panel into a predetermined number of display regions, and divide the to-be-displayed image into a predetermined number of display sub-images corresponding to the display regions in a one-to-one correspondence manner;

a calculation circuit configured to acquire a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; and a second processing circuit configured to, in the case that the grayscale change value of one of the display sub-images is greater than a first predetermined threshold, subject the display sub-image to the color enhancement; and in the case that the grayscale change value of one of the display sub-images is not greater than the first predetermined threshold, not subject the display sub-image to the color enhancement.

12. The display device according to claim 11, wherein a base substrate of the display panel is a silicon substrate, and the control circuit of the display panel is integrated into the silicon substrate.

13. The display device according to claim 7, wherein the processing circuit further comprises:

a division circuit configured to, in the case that the current display mode of the display panel is a third display mode, divide the to-be-displayed image into a predetermined number of display sub-images;

a resolution acquisition circuit configured to acquire a resolution of each of the display sub-images; and a third processing circuit configured to, in the case that the resolution of one of the display sub-images is greater than a second predetermined threshold, subject the display sub-image to the color enhancement; and in the case that the resolution of one of the display sub-images is not greater than the second predetermined threshold, not subject the display sub-image to the color enhancement.

14. The display device according to claim 13, wherein a base substrate of the display panel is a silicon substrate, and the control circuit of the display panel is integrated into the silicon substrate.

15. The control circuit according to claim 9, wherein the processor is further configured to read a program stored in the memory to:

in the case that the current display mode of the display panel is a second display mode, divide the display panel into a predetermined number of display regions, and divide the to-be-displayed image into a predetermined number of display sub-images corresponding to the display regions in a one-to-one correspondence manner;

acquire a grayscale change value of each of the display sub-images, the grayscale change value being a difference between a grayscale value of a pixel having a maximum grayscale value and a grayscale value of a pixel having a minimum grayscale value among pixels in the display region corresponding to the display sub-image; and in the case that the grayscale change value of one of the display sub-images is greater than a first predetermined threshold, subject the display sub-image to the color enhancement; and in the case that the grayscale change value of one of the display sub-images is not greater than the first predetermined threshold, not subject the display sub-image to the color enhancement.

16. The control circuit according to claim 9, wherein the processor is further configured to read a program stored in the memory to:

in the case that the current display mode of the display panel is a third display mode, divide the to-be-displayed image into a predetermined number of display sub-images;

acquire a resolution of each of the display sub-images; and in the case that the resolution of one of the display sub-images is greater than a second predetermined threshold, subject the display sub-image to the color enhancement; and in the case that the resolution of one of the display sub-images is not greater than the second predetermined threshold, not subject the display sub-image to the color enhancement.

* * * * *